US006830027B1

(12) United States Patent
Segawa et al.

(10) Patent No.: US 6,830,027 B1
(45) Date of Patent: Dec. 14, 2004

(54) CONTROL SYSTEM FOR INTERNAL COMBUSTION ENGINE

(75) Inventors: Makoto Segawa, Wako (JP); Haruhiko Yamada, Wako (JP); Masato Amano, Wako (JP); Yuichi Tamura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/866,603

(22) Filed: Jun. 10, 2004

(30) Foreign Application Priority Data

Jun. 10, 2003 (JP) ..... 2003-164754

(51) Int. Cl.[7] ..... F02B 77/00
(52) U.S. Cl. ..... 123/198 F; 123/332; 123/395
(58) Field of Search ..... 123/299, 305, 123/319, 332, 395, 198 F

(56) References Cited

U.S. PATENT DOCUMENTS 4,256,074 A * 3/1981 Sugasawa et al. ..... 60/276
6,725,830 B2 * 4/2004 Surnilla ..... 123/339.11

FOREIGN PATENT DOCUMENTS

JP 62-250351 10/1987
JP 2001-234792 8/2001

* cited by examiner

*Primary Examiner*—Bibhu Mohanty
(74) *Attorney, Agent, or Firm*—Lahive & Cockfield, LLP; Anthony A. Laurentano, Esq.

(57) ABSTRACT

A control system for an internal combustion engine having a plurality of cylinders and a switching mechanism for switching between an all-cylinder operation in which all of the cylinders is operated and a partial-cylinder operation in which at least one of the plurality of cylinders is halted. Operating parameters of a vehicle driven by the engine is detected. The all-cylinder operation or the partial-cylinder operation is performed according to the detected operating parameters. An oxygen concentration sensor is provided in an exhaust system corresponding to the at least one cylinder which is halted during the partial-cylinder operation. A failure of the oxygen concentration sensor is diagnosed in a predetermined operating condition including a fuel-cut operation of the engine upon deceleration. The partial-cylinder operation is permitted after completion of the failure diagnosis.

15 Claims, 7 Drawing Sheets

CONTROL SYSTEM FOR INTERNAL COMBUSTION ENGINE

BACKGROUND OF THE INVENTION

1. Field of the Invention

This invention relates to a control system for an internal combustion engine, and more specifically to a control system for an internal combustion engine having a plurality of cylinders and a cylinder halting mechanism for halting some of the cylinders.

2. Description of the Related Art

Japanese Patent Laid-Open No. Sho 62-250351 discloses a method for detecting an abnormality of an oxygen concentration sensor provided in an exhaust system of an internal combustion engine. According to this method, an abnormality of the oxygen concentration sensor is detected based on an output of the sensor during the fuel-cut operation in which fuel supply to the engine is stopped.

Further, Japanese Patent Laid-Open No. 2001-234792 discloses an internal combustion engine having a cylinder halting mechanism. By means of the cylinder halting mechanism, a partial-cylinder operation in which some of the plural cylinders are halted, and an all-cylinder operation in which all of the cylinders are operating are switched according to the operating condition of the engine. Specifically, the engine disclosed in Japanese Patent Laid-Open No. 2001-234792 is a V-type six-cylinder engine having a right bank and a left bank each of which includes three cylinders. When the engine is operating in a low load condition, operation of intake valves and exhaust valves of the three cylinders on the right bank is halted.

If the abnormality detection method disclosed in Japanese Patent Laid-Open No. Sho 62-250351 is applied as it is to an oxygen concentration sensor mounted on the engine disclosed in Japanese Patent Laid-Open No. 2001-234792, the following problem arises.

An oxygen concentration sensor is provided in an exhaust system of the engine in order to perform a feedback control of the air-fuel ratio. In one example of a V-type six-cylinder engine, two oxygen concentration sensors are disposed corresponding respectively to the right bank and the left bank. In this instance, when performing the partial-cylinder operation, operation of the intake valves and exhaust valves of the right bank is stopped. Consequently, no exhaust gas flows through the exhaust pipe on the right bank, but exhaust gases exhausted immediately before the valve stoppage stay in the exhaust pipe. As a result, the oxygen concentration sensor does not detect a high oxygen concentration which is to be detected during the fuel-cut operation, to thereby make a wrong determination is made that the oxygen concentration sensor is abnormal.

SUMMARY OF THE INVENTION

It is an object of the present invention to provide a control system for an internal combustion engine, which can accurately determine a failure of an oxygen concentration sensor mounted on the internal combustion engine whose operation is switched between the partial-cylinder operation and the all-cylinder operation.

The present invention provides a control system for an internal combustion engine (1) having a plurality of cylinders (#1–#6) and switching means (30) for switching between an all-cylinder operation in which all of the cylinders is operated and a partial-cylinder operation in which at least one of the plurality of cylinders is halted. The control system includes operating parameter detecting means (4, 8–10, 15, 16), instructing means, an oxygen concentration sensor (22R), diagnosing means, and permitting means. The operating parameter detecting means detects operating parameters of a vehicle driven by the engine. The operating parameters include at least one operating parameter of the engine. The instructing means instructs the switching means (30) to perform the all-cylinder operation or the partial-cylinder operation according to the operating parameters. The oxygen concentration sensor (22R) is provided in an exhaust system (13R) corresponding to the at least one cylinder (#1–#3) which is halted during the partial-cylinder operation, and detects an oxygen concentration in exhaust gases. The diagnosing means diagnoses a failure of the oxygen concentration sensor (22R) in a predetermined operating condition including a fuel-cut operation of the engine upon deceleration. In the fuel-cut operation, fuel supply to the engine is stopped. The permitting means permits the partial-cylinder operation after completion of the failure diagnosis by the diagnosing means.

With this configuration, the failure diagnosis of the oxygen concentration sensor provided on the exhaust system of the engine is performed in the predetermined operating condition including fuel-cut operation upon deceleration of the engine, and partial-cylinder operation is permitted after completion of the failure diagnosis. Accordingly, the failure diagnosis of the oxygen concentration sensor is first performed during the all-cylinder operation, and the partial-cylinder operation is made executable after completion of the failure diagnosis. Therefore, a failure of the oxygen concentration sensor mounted on the halted cylinder side can be diagnosed accurately.

Preferably, the engine has a first bank including a plurality of cylinders (#1–#3) and a second bank including a plurality of cylinders (#4#6), and the plurality of cylinders (#1–#3) on the first bank are halted during the partial-cylinder operation.

Preferably, the engine has a first exhaust pipe (13R) connected to the first bank and a second exhaust pipe (13L) connected to the second bank, and the oxygen concentration sensor (22R) is disposed in the first exhaust pipe (13R).

Preferably, the diagnosing means determines that the oxygen concentration sensor (22R) fails, when an output (SVO2) of the oxygen concentration sensor indicates a rich air-fuel ratio immediately after starting of the fuel-cut operation, and the output (SVO2) of the oxygen concentration sensor still indicates a rich air-fuel ratio after a first predetermined time period (TMMODE2) has elapsed from the starting of the fuel-cut operation.

Preferably, the diagnosing means determines that the oxygen concentration sensor is normal, when an output of the oxygen concentration sensor indicates a lean air-fuel ratio immediately after starting of the fuel-cut operation, and the output of the oxygen concentration sensor changes to a value indicative of a rich air-fuel ratio within a second predetermined time period (TMMODE3) after the fuel cut operation ends.

DETAILED DESCRIPTION OF THE PREFERRED EMBODIMENTS

Embodiments of the present invention will be hereinafter described with reference to the drawings.

Figure 1:
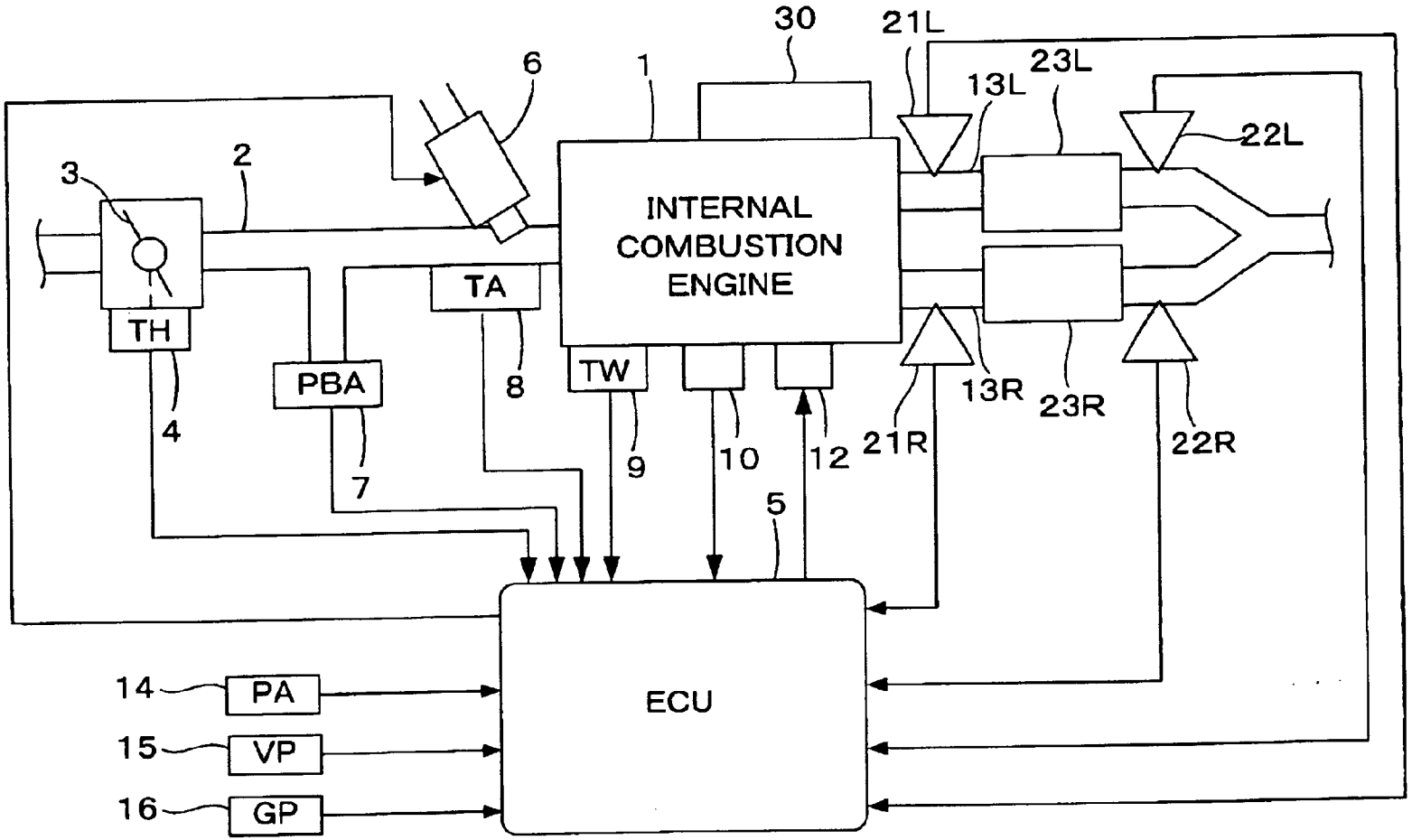
FIG. 1 is a schematic diagram showing a configuration of an internal combustion engine and a control apparatus therefor according to an embodiment of the present invention.
Figure 2:
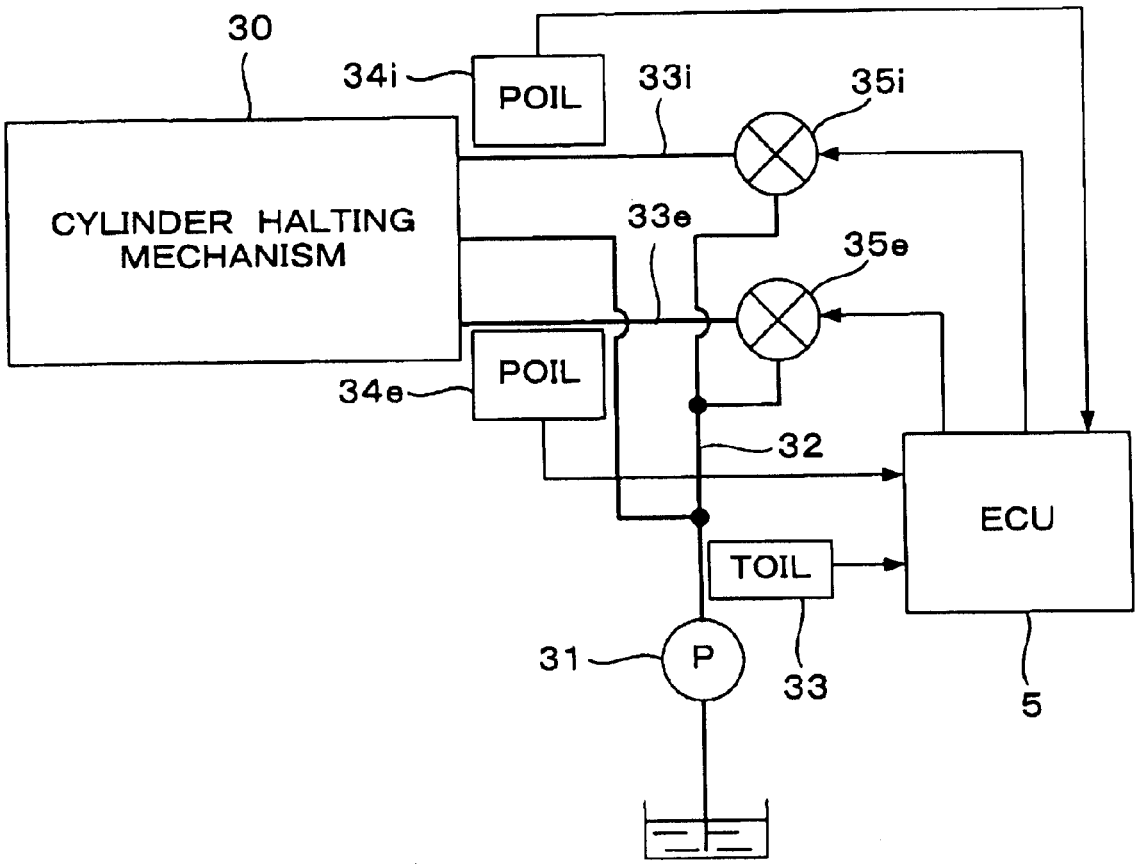
FIG. 2 is a schematic diagram showing a configuration of a hydraulic control system of a cylinder halting mechanism.

FIG. 1 is a schematic diagram of an internal combustion engine and a corresponding control apparatus according to an embodiment of the present invention. The internal combustion engine 1, which may be, for example, a V-type six-cylinder internal combustion engine but is hereinafter referred to simply as "engine", has a right bank including cylinders #1, #2, and #3 and a left bank including cylinders #4, #5, and #6. The right bank further includes a cylinder halting mechanism 30, which temporarily halts operation of cylinders #1 to #3. FIG. 2 is a schematic diagram of a hydraulic circuit for hydraulically driving the cylinder halting mechanism 30 and a control system for the hydraulic circuit. FIG. 2 will be referred to in conjunction with FIG. 1.

The engine 1 has an intake pipe 2 including a throttle valve 3. The throttle valve 3 is provided with a throttle valve opening sensor 4, which detects an opening TH of the throttle valve 3. A detection signal output from the throttle opening sensor 4 is supplied to an electronic control unit, which is hereinafter referred to as "ECU 5".

Fuel injection valves 6, for respective cylinders, are inserted into the intake pipe 2 at locations intermediate between the engine 1 and the throttle valve 3, and slightly upstream of respective intake valves (not shown). Each fuel injection valve 6 is connected to a fuel pump (not shown) and electrically connected to the ECU 5. A valve opening period of each fuel injection valve 6 is controlled by a signal from the ECU 5.

An absolute intake pressure (PBA) sensor 7 is provided immediately downstream of the throttle valve 3 and detects a pressure in the intake pipe 2. An absolute pressure signal converted to an electrical signal by the absolute intake pressure sensor 7 is supplied to the ECU 5. An intake air temperature (TA) sensor 8 is provided downstream of the absolute intake pressure sensor 7 and detects an intake air temperature TA. An electrical signal corresponding to the detected intake air temperature TA is output from the sensor 8 and supplied to the ECU 5.

An engine coolant temperature (TW) sensor 9 such as, for example, a thermistor, is mounted on the body of the engine 1 and detects an engine coolant temperature, i.e., a cooling water temperature, TW. A temperature signal corresponding to the detected engine coolant temperature TW is output from the sensor 9 and supplied to the ECU 5.

A crank angle position sensor 10 detects a rotational angle of the crankshaft (not shown) of the engine 1 and is connected to the ECU 5. A signal corresponding to the detected rotational angle of the crankshaft is supplied to the ECU 5. The crank angle position sensor 10 includes a cylinder discrimination sensor which outputs a pulse at a predetermined crank angle position for a specific cylinder of the engine 1, the pulse hereinafter is referred to as "CYL pulse". The crank angle position sensor 10 also includes a top dead center (TDC) sensor which outputs a TDC pulse at a crank angle position before a TDC of a predetermined crank angle starts at an intake stroke in each cylinder, i.e., at every 120 deg crank angle in the case of a six-cylinder engine, and a constant crank angle (CRK) sensor for generating one pulse with a CRK period, e.g., a period of 30 deg, shorter than the period of generation of the TDC pulse, the pulse hereinafter is referred to as "CRK pulse". The CYL pulse, the TDC pulse, and the CRK pulse are supplied to the ECU 5. The CYL, TDC, and CRK pulses are used to control the various timings, such as a fuel injection timing and an ignition timing, and to detect an engine rotational speed NE.

The cylinder halting mechanism 30 is hydraulically driven using lubricating oil of the engine 1 as operating oil. The operating oil, which is pressurized by an oil pump 31, is supplied to the cylinder halting mechanism 30 via an oil passage 32, an intake side oil passage 33*i*, and an exhaust side oil passage 33*e*. An intake side solenoid valve 35*i* is provided between the oil passage 32 and the intake side oil passage 33*i*, and an exhaust side solenoid valve 35*e* is provided between the oil passage 32 and the exhaust side oil passage 33*e*. The intake and exhaust side solenoid valves 35*i* and 35*e*, respectively, are connected to the ECU 5 so that the operation of the solenoid valves 35*i* and 35*e* is controlled by the ECU 5.

Hydraulic switches 34*i* and 34*e*, which are turned on when the operating oil pressure drops to a pressure lower than a predetermined threshold value, are provided, respectively, for the intake and exhaust side oil passages 33*i* and 33*e*. Detection signals of the hydraulic switches 34*i* and 34*e* are supplied to the ECU 5. An operating oil temperature sensor 33, which detects an operating oil temperature TOIL, is provided in the oil passage 32, and a detection signal of the operating oil temperature sensor 33 is supplied to the ECU 5.

An exemplary configuration of a cylinder halting mechanism is disclosed in Japanese Patent Laid-open No. Hei 10-103097, and a similar cylinder halting mechanism is used as the cylinder halting mechanism 30 of the present invention. The contents of Japanese Patent Laid-open No. Hei 10-103097 are hereby incorporated by reference. According to the cylinder halting mechanism 30, when the solenoid valves 35*i* and 35*e* are closed and the operating oil pressures in the oil passages 33*i* and 33*e* are low, the intake valves and the exhaust valves of the cylinders, i.e., #1 to #3, perform normal opening and closing movements. On the other hand, when the solenoid valves 35*i* and 35*e* are open and the operating oil pressures in the oil passages 33*i* and 33*e* are high, the intake valves and the exhaust valves of the cylinders, i.e., #1 to #3, maintain their closed state. In other words, while the solenoid valves 35*i* and 35*e* are closed, all-cylinder operation of the engine 1, in which all cylinders are operating, is performed, and if the solenoid valves 35*i* and 35*e* are opened, partial-cylinder operation, in which the cylinders #1 to #3 do not operate and only the cylinders #4 to #6 are operating, is performed.

An exhaust pipe 13R connected to the cylinders #1 to #3 of the right bank includes a three-way catalyst 23R for purifying exhaust gases. An exhaust pipe 13L connected to the cylinders #4 to #6 of the left bank includes a three-way catalyst 23L for purifying exhaust gases. A proportional type oxygen concentration sensor (hereinafter referred to as "LAF sensor") 21R is disposed upstream of the three-way catalyst 23R, and another LAF sensor 21L is disposed upstream of the three-way catalyst 23L. Each of the LAF sensors 21R and 21L outputs a detection signal proportional to an oxygen concentration in the exhaust gases and supplies the detection signal to the ECU 5. An oxygen concentration sensor (hereinafter referred to as "O2 sensor") 22R for detecting an oxygen concentration in exhaust gases is disposed downstream of the three-way catalyst 23R, and another O2 sensor 22L for detecting an oxygen concentration in exhaust gases is disposed downstream of the three-way catalyst 23L. Each of the O2 sensors 22R and 22L has a characteristic such that its output rapidly changes in the vicinity of the stoichiometric ratio. More specifically, each of the sensors 22R and 22L outputs a high level signal in a rich region with respect to the stoichiometric ratio, and outputs a low level signal in a lean region with respect to the stoichiometric ratio. The O2 sensors 22R and 22L are connected to the ECU 5, and the detection signals output from these sensors are supplied to the ECU 5.

A spark plug 12 is provided in each cylinder of the engine 1. Each spark plug 12 is connected to the ECU 5, and a drive signal for each spark plug 12, i.e., an ignition signal, is supplied from the ECU 5.

An atmospheric pressure sensor 14 for detecting the atmospheric pressure PA, a vehicle speed sensor 15 for detecting a running speed (vehicle speed) VP of the vehicle driven by the engine 1, and a gear position sensor 16 for detecting a gear position GP of a transmission of the vehicle. Detection signals of these sensors are supplied to the ECU 5.

The ECU 5 includes an input circuit, a central processing unit, which is hereinafter referred to as "CPU", a memory circuit, and an output circuit. The input circuit performs numerous functions, including, but not limited to, shaping the waveforms of input signals from the various sensors, correcting the voltage levels of the input signals to a predetermined level, and converting analog signal values into digital signal values. The memory circuit preliminarily stores various operating programs to be executed by the CPU and stores the results of computations or the like by the CPU. The output circuit supplies drive signals to the fuel injection valves 6, the spark plugs 12, and the solenoid valves 35*i* and 35*e*. The ECU 5 controls the valve opening period of each fuel injection valve 6, the ignition timing, and the opening of the EGR valve 22 according to the detection signals from the various sensors. The ECU 5 further operates the intake and exhaust side solenoid valves 35*i* and 35*e* to perform switching control between the all-cylinder operation and the partial-cylinder operation of the engine 1. Further, the ECU 5 performs a failure diagnosis of the O2 sensors 22R and 22L.

The CPU in the ECU 5 determines various engine operating conditions according to various detection signals as mentioned above, and calculates a fuel injection period TOUT of each fuel injection valve 6 to be opened in synchronism with the TDC pulse, in accordance with the following equation (1) according to the above determined engine operating conditions.

$$TOUT=TI\times KCMD\times KLAF\times K1+K2 \quad (1)$$

TI is a basic fuel injection period of each fuel injection valve 6, and it is determined by retrieving a TI map set according to the engine rotational speed NE and the absolute intake pressure PBA. The TI map is set so that the air-fuel ratio of an air-fuel mixture to be supplied to the engine 1 becomes substantially equal to the stoichiometric ratio in an operating condition according to the engine rotational speed NE and the absolute intake pressure PBA.

KCMD is a target air-fuel ratio coefficient, which is set according to engine operational parameters such as the engine rotational speed NE, the throttle valve opening THA, and the engine coolant temperature TW. The target air-fuel ratio coefficient KCMD is proportional to the reciprocal of an air-fuel ratio A/F, i.e., proportional to a fuel-air ratio F/A, and takes a value of 1.0 for the stoichiometric ratio, therefore, KCMD is referred to also as a target equivalent ratio.

KLAF is an air-fuel ratio correction coefficient calculated by PID (Proportional Integral Differential) control so that a detected equivalent ratio KACT calculated from detected values from the LAF sensors 21R and 21L becomes equal to the target equivalent ratio KCMD. When the feedback control according to the LAF sensors 21R and 21L is not performed, the air-fuel ratio correction coefficient KLAF is set to a non-correction value (1.0) or a learning value.

K1 and K2 are respectively a correction coefficient and a correction variable computed according to various engine parameter signals. The correction coefficient K1 and correction variable K2 are set to predetermined values that optimize various characteristics such as fuel consumption characteristics and engine acceleration characteristics, according to engine operating conditions.

The CPU in the ECU 5 supplies a drive signal for opening each fuel injection valve 6 according to the fuel injection period TOUT obtained above, through the output circuit to the fuel injection valve 6.

Figure 3:
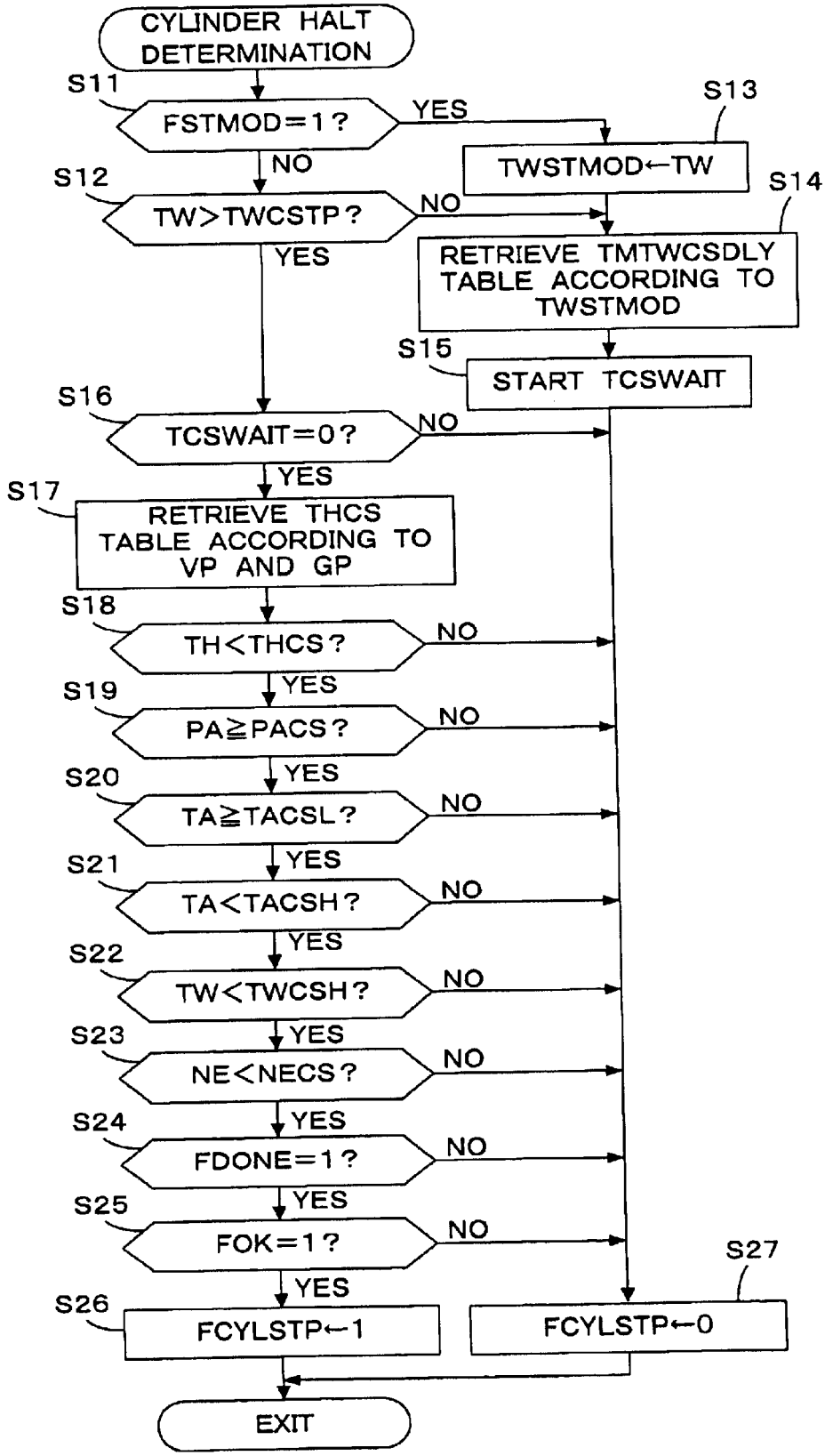
FIG. 3 is a flow chart of a process for determining a cylinder halt condition.

FIG. 3 is a flow chart of a process of determining an execution condition of the cylinder halt (partial-cylinder operation) in which some of the cylinders are halted. This process is executed at predetermined intervals (for example, 10 milliseconds) by the CPU of the ECU 5.

Figure 4:
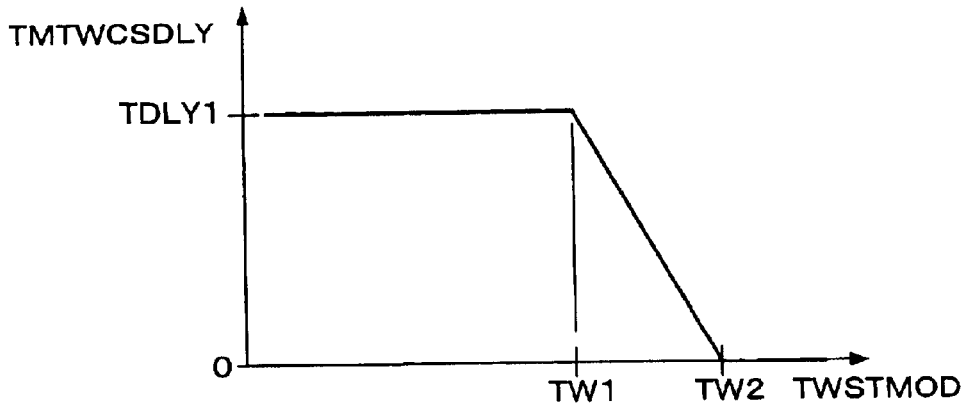
FIG. 4 is a graph showing a TMTWCSDLY table used in the process of FIG. 3.

In step S11, it is determined whether or not an start mode flag FSTMOD is "1". If FSTMOD is equal to "1", which indicates that the engine 1 is starting (cranking), then the detected engine water temperature TW is stored as a start mode water temperature TWSTMOD (step S13). Next, a TMTWCSDLY table shown in FIG. 4 is retrieved according to the start mode water temperature TWSTMOD to calculate a delay time TMTWCSDLY. In the TMTWCSDLY table, the delay time TMTWCSDLY is set to a predetermined delay time TDLY1 (for example, 250 seconds) in the range where the start mode water temperature TWSTMOD is lower than a first predetermined water temperature TW1 (for example, 40° C.). The delay time TMTWCSDLY is set so as to decrease as the start mode water temperature TWSTMOD rises in the range where the start mode water temperature TWSTMOD is equal to or higher than the first predetermined water temperature TW1 and lower than a second predetermined water temperature TW2 (for example, 60° C.). Further, the delay time TMTWCSDLY is set to "0" in the range where the start mode water temperature TWSTMOD is higher than the second predetermined water temperature TW2.

In next step S15, a downcount timer TCSWAIT is set to the delay time TMTWCSDLY and started, and a cylinder halt flag FCYLSTP is set to "0" (step S27). This indicates that the execution condition of the cylinder halt is not satisfied.

If FSTMOD is equal to "0" in step S11, i.e., the engine 1 is operating in the ordinary operation mode, then it is determined whether or not the engine water temperature TW is higher than a cylinder halt determination temperature TWCSTP (for example, 75° C.) (step S12). If TW is less than or equal to TWCSTP, then it is determined that the execution condition is not satisfied, and the process advances to step S14. When the engine water temperature TW is higher than the cylinder halt determination temperature TWCSTP, the process advances from step S12 to step S16, in which it is determined whether or not a value of the timer TCSWAIT started in step S15 is "0". While TCSWAIT is greater than "0", the process advances to step S27. When TCSWAIT becomes "0", then the process advances to step S17.

Figure 5:
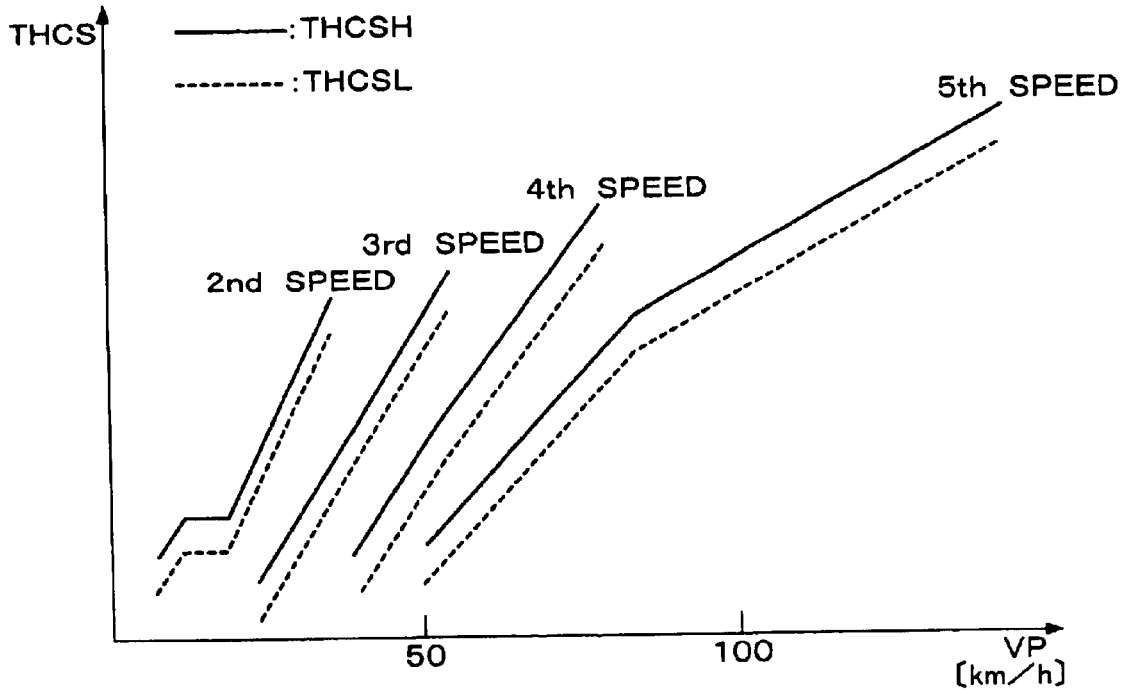
FIG. 5 is a graph showing a THCS table used in the process of FIG. 3.

In step S17, a THCS table shown in FIG. 5 is retrieved according to the vehicle speed VP and the gear position GP to calculate an upper side threshold value THCSH and a lower side threshold value THCSL which are used in the determination in step S18. In FIG. 5, the solid lines correspond to the upper side threshold value THCSH and the broken lines correspond to the lower side threshold value THCSL. The THCS table is set for each gear position GP such that, at each of the gear positions (from second speed to fifth speed), the upper side threshold value THCSH and the lower side threshold value THCSL may increase as the vehicle speed VP increases. It should be noted that at the gear position of 2nd speed, there is provided a region where the upper side threshold value THCSH and the lower side threshold value THCSL are maintained at a constant value even if the vehicle speed VP varies. Further, at the gear position of 1st speed, the upper side threshold value THCSH and the lower side threshold value THCSL are set, for example, to "0", since the all-cylinder operation is always performed. Furthermore, the threshold values (THCSH and THCSL) corresponding to a lower speed side gear position GP are set to greater values than the threshold values (THCSH and THCSL) corresponding to a higher speed side gear position GP when compared at a certain vehicle speed.

In step S18, a determination of whether or not the throttle valve opening TH is less than the threshold value THCS is executed with hysteresis. Specifically, when the cylinder halt flag FCYLSTP is "1", and the throttle valve opening TH increases to reach the upper side threshold value THCSH, then the answer to step S18 becomes negative (NO), while when the cylinder halt flag FCYLSTP is "0", and the throttle valve opening TH decreases to become less than the lower side threshold value THCSL, then the answer to step S18 becomes affirmative (YES).

If the answer to step S18 is affirmative (YES), it is determined whether or not the atmospheric pressure PA is equal to or higher than a predetermined pressure PACS (for example, 86.6 kPa (650 mmHg)) (step S19). If the answer to step S19 is affirmative (YES), then it is determined whether or not the intake air temperature TA is equal to or higher than a predetermined lower limit temperature TACSL (for example, −10° C.) (step S20). If the answer to step S20 is affirmative (YES), then it is determined whether or not the intake air temperature TA is lower than a predetermined upper limit temperature TACSH (for example, 45° C.) (step S21). If the answer to step S21 is affirmative (YES), then it is determined whether or not the engine water temperature TW is lower than a predetermined upper limit water temperature TWCSH (for example, 120° C.) (step S22). If the answer to step S22 is affirmative (YES), then it is determined whether or not the engine speed NE is lower than a predetermined speed NECS (step S23).

The determination of step S23 is executed with hysteresis similarly as in step S18. Specifically when the cylinder halt flag FCYLSTP is "1", and the engine speed NE increases to reach an upper side speed NECSH (for example, 3,500 rpm), then the answer to step S23 becomes negative (NO), while when the cylinder halt flag FCYLSTP is "0", and the engine speed NE decreases to become lower than a lower side speed NECSL (for example, 3,300 rpm), then the answer to step S23 becomes affirmative (YES).

Figure 6:
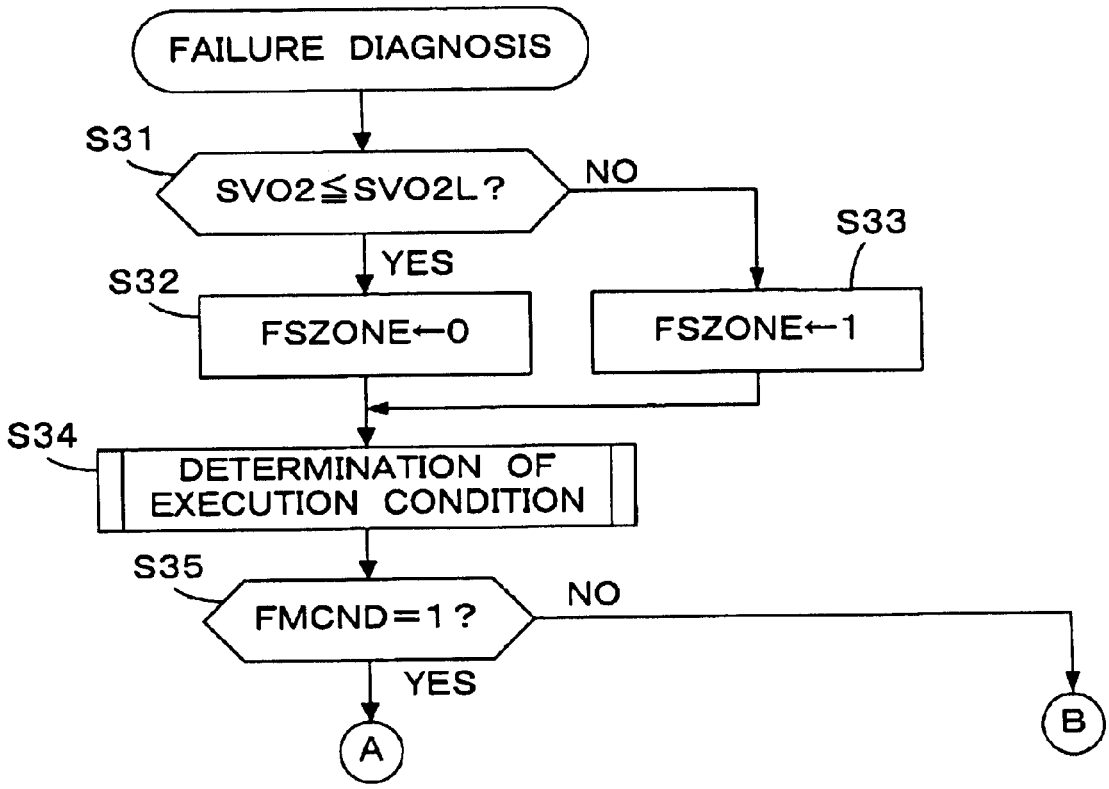
FIGS. 6 and 7 are flow charts of a process for diagnosing a failure of an oxygen concentration sensor.
Figure 7:
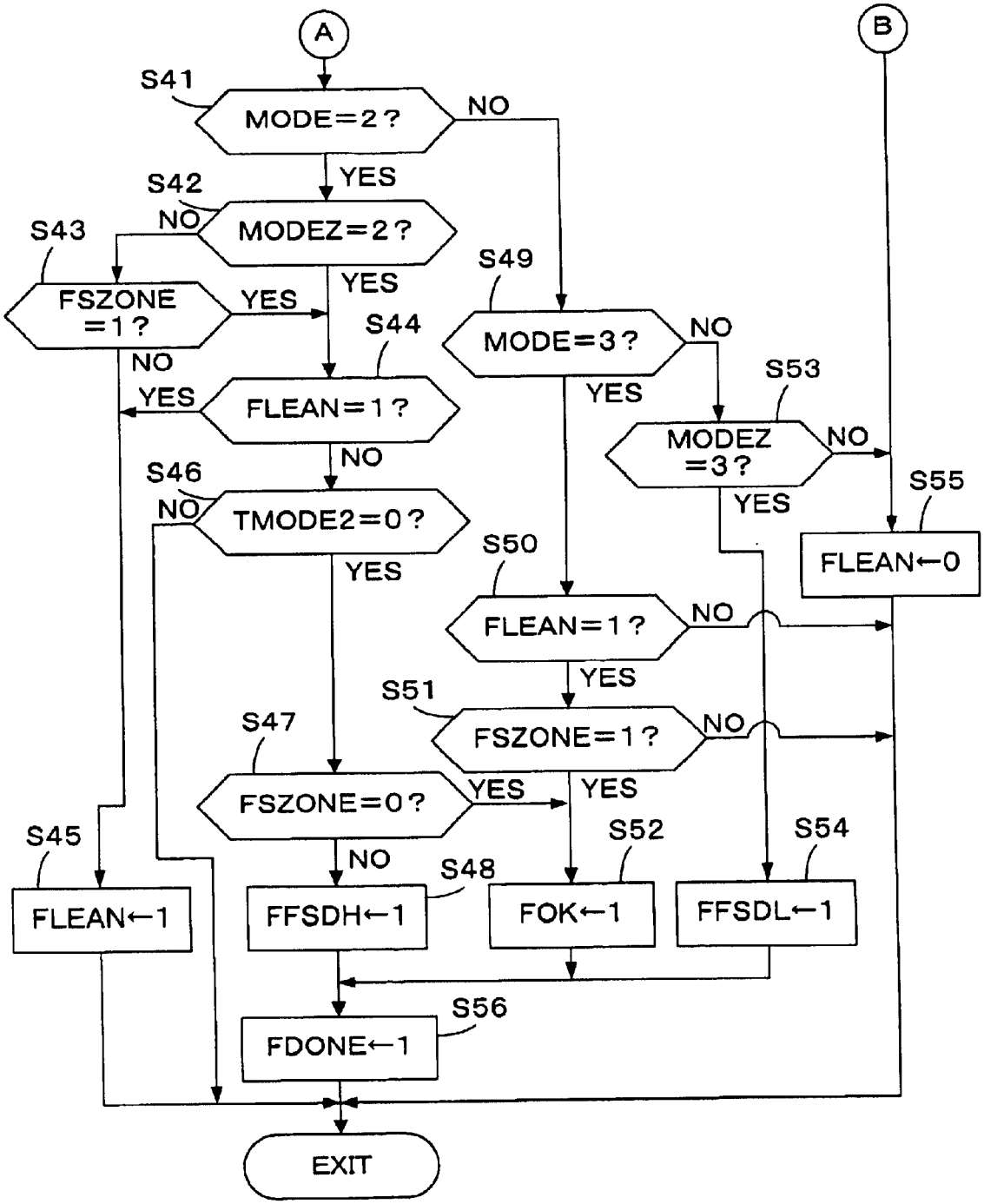

In step S24, it is determined whether or not a diagnosis end flag FDONE is "1". The diagnosis end flag FDONE is set to "1" when the failure diagnosis of the O2 sensor 22R shown in FIGS. 6 and 7 is completed. If FDONE is equal to "0", indicating that the failure diagnosis is not completed, the process proceeds to step S27 described above. If the failure diagnosis of the O2 sensor 22R is completed and the diagnosis end flag FDONE is set to "1", then the process proceeds to step S25, in which it is determined whether or not a normal flag FOK is "1". The normal flag FOK is set to "1" when the O2 sensor 22R is determined to be normal as a result of the failure diagnosis.

When the answer to any of steps S18 to S25 is negative (NO), it is determined that the execution condition of the cylinder halt is not satisfied, and the process advances to step S27. On the other hand, if all of the answers to steps S18 to S25 are affirmative (YES), it is determined that the execution condition of the cylinder halt is satisfied, and the cylinder halt flag FCYLSTP is set to "1" (step S26).

When the cylinder halt flag FCYLSTP is set to "1", the partial-cylinder operation in which cylinders #1 to #3 are halted while cylinders #4 to #6 are operated, is performed. When the cylinder halt flag FCYLSTP is set to "0", the all-cylinder operation in which all of the cylinders #1 to #6 are operated, is performed.

According to the process of FIG. 3, when the failure diagnosis of the O2 sensor 22R is completed, and the normal determination is made, the cylinder halting execution condition is satisfied and the partial-cylinder operation is permitted. Accordingly, since the failure diagnosis of the O2 sensor 22R is first performed during the all-cylinder operation, and the partial-cylinder operation is made executable after the failure diagnosis is completed, a failure of the O2 sensor 22R mounted on the halting cylinder side (right bank) can be diagnosed accurately. Further, the reason why the partial-cylinder operation is inhibited when the O2 sensor 22R fails is that the output of the O2 sensor 22R is used in the failure diagnosis of the cylinder halting mechanism 30.

FIGS. 6 and 7 are flow charts of the failure diagnosis process of the O2 sensor 22R. This process is executed at predetermined time intervals (for example, 10 milliseconds) by the CPU in the ECU 5.

In step S31, it is determined whether or not the output voltage SVO2 of the O2 sensor 22R is equal to or lower than a predetermined voltage SVO2L (for example, 0.29 V). If SVO2 is less than or equal to SVO2L, i.e., the output of the O2 sensor 22R indicates a lean air-fuel ratio (comparatively high oxygen concentration), then a zone flag FSZONE is set to "0" (step S32). On the other hand, if SVO2 is higher than SVO2L, i.e., the output of the O2 sensor 22R indicates a rich air-fuel ratio (comparatively low oxygen concentration), then the zone flag FSZONE is set to "1" (step S33).

Figure 8:
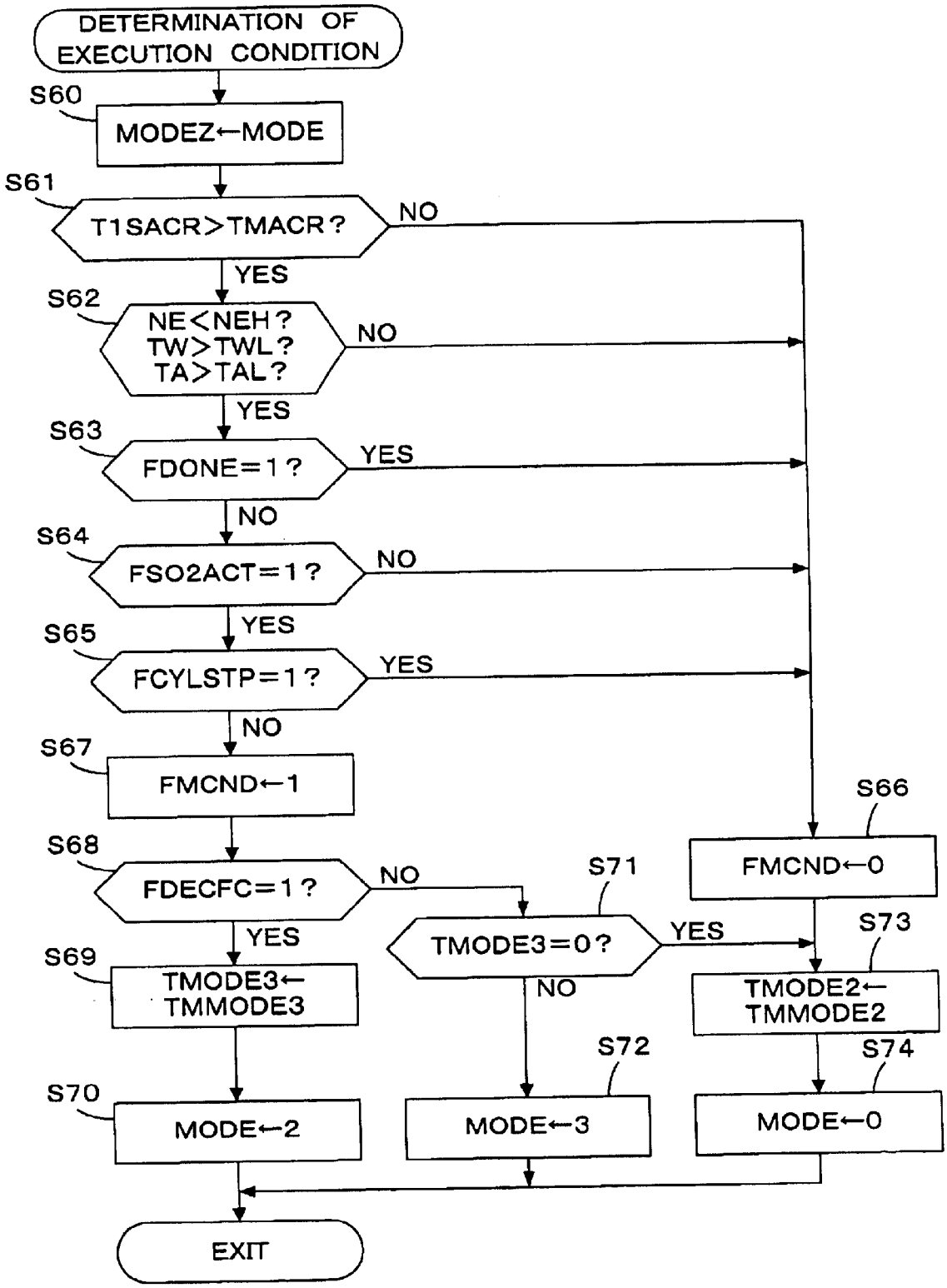
FIG. 8 is a flow chart of a process executed in the process of FIG. 6 for determining an execution condition of the failure diagnosis.

In step S34, an execution condition determination process shown in FIG. 8 is executed.

In step S60 of FIG. 8, a value of a mode parameter MODE is not yet updated in the process of FIG. 8, is stored as a preceding mode parameter MODEZ. In step S61, it is determined whether or not a value of an upcount timer TISACR for measuring the elapsed time after the time of completion of starting of the engine 1 is greater than a predetermined time period TMRCR (for example, 120 seconds). If the answer to this step is negative (NO), then the diagnosis permission flag FMCND is set to "0" (step S66). This indicates that the diagnosis execution condition is not satisfied.

Next, in step S73, a downcount timer TMODE2 is set to a predetermined time period TMMODE2 (for example, 2.5 seconds) and started. The downcount timer TMODE2 is referred to in step S46 of FIG. 7. In step S74, the mode parameter MODE is set to "0", and the present process ends.

If the value of the timer TISACR exceeds a predetermined time period TMACR in step S61, then it is determined whether or not the engine rotational speed NE is lower than a predetermined speed NEH, whether or not the engine water temperature TW is higher than a predetermined water temperature TWL and whether or not the intake air temperature TA is higher than a predetermined intake air temperature TAL (step S62). If the answer to any of the determinations is negative (NO), then the process advances to step S66 described above. If all of the answers to step S62 are affirmative (YES), that is, if NE is lower than NEH, TW is higher than TWL, and TA is higher than TAL, then it is determined whether or not the diagnosis end flag FDONE is set already to "1" (step S63). If FDONE is equal to "1", indicating that the diagnosis is already completed, then the process advances to step S66 described above. If FDONE is equal to "0", then it is determined whether or not an activation flag FSO2ACT is "1" (step S64).

The activation flag FSO2ACT is set to "1" when the O2 sensor 22R is determined to be activated. Specifically, if the sensor output SVO2 at the time a predetermined time period has elapsed from starting of the engine 1 falls within a predetermined range, then the O2 sensor 22R is determined to be activated.

If the answer to step S64 is negative (NO), then the processing advances to step S66 described above. If FSO2ACT is equal to "1", indicating that the O2 sensor 22R is activated, then it is determined whether or not the cylinder halt flag FCYLSTP is "1" (step S65). If FCYLSTP is equal to "1", indicating that the partial-cylinder operation is performed, then the process advances to step S66 described above. If FCYLSTP is equal to "0", indicating that the all-cylinder operation is performed, then it is determined that the failure diagnosis execution condition is satisfied, and the diagnosis permission flag FMCND is set to "1" (step S67).

In step S68, it is determined whether or not a deceleration fuel cut flag FDECFC is "1". The deceleration fuel cut flag FDECFC is set to "1" when a predetermined fuel cut condition is satisfied during deceleration of the engine 1. If FDECFC is equal to "1", indicating that the fuel cut operation is performed, a downcount timer TMODE3 is set to a predetermined time period TMMODE3 (for example, 30 seconds) and started (step S69). Next, the mode parameter MODE is set to "2" (step S70), and the present process ends.

If FDECFC is equal to "O" in step S68, indicating that the fuel cut operation is not performed, then it is determined whether or not the value of the timer TMODE3 started in step S69, is "0" (step S71). If TMODE3 greater than "0", which indicates that the predetermined time period TMMODE3 has not elapsed from the end of the fuel cut operation, then the mode parameter MODE is set to "3" (step S72). If the value of the downcount timer TMODE3 becomes "0", then the process advances to step S73 described above.

According to the process of FIG. 8, when fuel cut operation is performed, the mode parameter MODE is set to "2". Further, the mode parameter MODE is set to "3" during the predetermined time period TMMODE3 from the end of the fuel cut operation. In other cases, the mode parameter MODE is set to "0".

Referring back to FIG. 6, in step S35, it is determined whether or not the diagnosis permission flag FMCND is "1". If FMCND is equal to "0", i.e., the diagnosis is not permitted, then a lean flag FLEAN is set to "0" (step S55).

If FMCND is equal to "1". I.e., the diagnosis is permitted, then it is determined whether or not the value of the mode parameter MODE is equal to "2" (step S41). If MODE is equal to "2", then it is determined whether or not the value of the preceding mode parameter MODEZ is equal to "2" (step S42). If the answer to this step is negative (NO), indicating that the present execution is immediately after the mode parameter MODE has changed to "2", then it is determined whether or not the zone flag FSZONE is "1" (step S43). If FSZONE is equal to "0", i.e., the O2 sensor output SVO2 indicates a lean air-fuel ratio, then the lean flag FLEAN is set to "1" (step S45). That is, when the O2 sensor output SVO2 indicates a lean air-fuel ratio upon starting of the fuel cut operation, the lean flag FLEAN is set to "l".

If MODEZ is equal to "2" in step S42, indicating that the mode parameter MODE was equal to "2" also in the preceding cycle, or if FSZONE is equal to "1" in step S43, i.e., the O2 sensor output SVO2 indicates a rich air-fuel ratio, then the process advances to step S44, in which it is determined whether or not the lean flag FLEAN is "1". If the answer to this step is affirmative (YES), that is, if the O2 sensor output SVO2 indicated a lean air-fuel ratio upon starting of the fuel cut operation, then the process advances to step S45 described above.

If the process reaches step S44 from step S42 via step S43, the O2 sensor output SVO2 indicates a rich air-fuel ratio immediately after starting of the fuel cut operation, and the answer to step S44 becomes negative (NO). Accordingly, the process advances to step S46.

In step S46, it is determined whether or not the value of the downcount timer TMODE2 started in step S73 of FIG. 8 is "0". While the answer to this step is negative (NO), the present process immediately ends. If TMODE2 becomes "0", then it is determined whether or not the zone flag FSZONE is "0" (step S47). If FSZONE is equal to "1", i.e., the O2 sensor output SVO2 still indicates a rich air-fuel ratio, then it is determined that the O2 sensor 22R fails (a failure that the output voltage SVO2 remains at a level indicative of a rich air-fuel ratio), and a first failure flag FFSDH is set to "1" (step S48). On the other hand, if FZONE is equal to "0", indicating that the O2 sensor output SVO2 has changed to a value indicative of a lean air-fuel ratio, then it is determined that the O2 sensor 22R is normal, and the normal flag FOK is set to "1" (step S52). In step S56, the diagnosis end flag FDONE is set to "1".

If the value of the mode parameter MODE is not equal to "2" in step S42, then it is determined whether or not the value of the mode parameter MODE is equal to "3" (step S49). If MODE is equal to "3", indicating that the predetermined time period TMMODE3 has not elapsed from the time the fuel cut operation ends, then it is determined whether or not the lean flag FLEAN is "1" (step S50). If FLEAN is equal to "1", then it is determined whether or not the zone flag FSZONE is "1" (step S51). If the answer to step S50 or S51 is negative (NO), then the present process immediately ends.

If the answers to both of steps S50 and S51 are affirmative (YES), that is, if the O2 sensor output SVO2, which indicated a lean air-fuel ratio immediately after starting of the fuel cut operation, changes to a value indicative of a rich air-fuel ratio within a predetermined time period from the time the fuel cut operation ends, then it is determined that the O2 sensor 22R is normal, and the normal flag FOK is set to "1" (step S52). Thereafter, the process advances to step S56 described above.

If the value of the mode parameter MODE is not equal to "3" in step S49, that is, if the value of the mode parameter MODE is equal to "0", then the process advances to step S53, in which it is determined whether or not the value of the preceding mode parameter MODEZ is equal to "3". If MODEZ is equal to "3", indicating that the value of the mode parameter MODE has changed from "3" to "0", then a second failure flag FFSDL is set to "1" (step S54). If the OK determination is not made when the value of the mode parameter MODE is "3", and the value of the mode parameter MODE changes from "3" to "0", then this indicates a failure that the output SVO2 of the O2 sensor 22R remains at a value (low level indicative of a lean air-fuel ratio. Therefore, the second failure flag FFSDL is set to "1". Thereafter, the process advances to step S56 described above.

If the answer to step S53 is negative (NO), then the process advances to step S55 described above.

It is to be noted that the failure diagnosis of the O2 sensor 22L is also performed by a process similar to the process shown in FIGS. 6 and 7.

According to the process of FIGS. 6 and 7, when the O2 sensor output SVO2 indicates a rich air-fuel ratio (FLEAN is equal to "o") immediately after starting of the fuel cut operation, and the O2 sensor output SVO2 still indicates a rich air-fuel ratio even after the predetermined time period TMMODE2 has elapsed (when the answer to step S47 is negative (NO)), it is determined that the O2 sensor fails. On the other hand, if the O2 sensor output SVO2 changes to a value indicative of a lean air-fuel ratio before the predetermined time period TMMODE2 (for example, 2.5 seconds) elapses, then it is determined that the O2 sensor is normal. Further, if the O2 sensor output SVO2 indicates a lean air-fuel ratio (FLEAN is equal to "1") immediately after starting of the fuel cut operation, and changes to a value indicative of a rich air-fuel within the predetermined time period TMMODE3 (for example, 30 seconds) after the fuel cut operation ends, then it is determined that the O2 sensor is normal. After the failure diagnosis process of the O2 sensor 22R ends and it is determined that the O2 sensor 22R is normal, the partial-cylinder operation is permitted in the process of FIG. 3. Accordingly, since the failure diagnosis of the O2 sensor 22R is first performed during the all-cylinder operation and then the partial-cylinder operation is made executable after the failure diagnosis ends, a failure of the O2 sensor 22R mounted on the halting cylinder side (right bank) can be diagnosed accurately.

In the present embodiment, the cylinder halting mechanism 30 constitutes the switching means, and the throttle valve opening sensor 4, the intake air temperature sensor 8, the engine water temperature sensor 9, the crank angle position sensor 10, the vehicle speed sensor 15, and the gear position sensor 16 constitute the operating parameter detecting means. One of ordinary skill in the art will appreciate that the cylinder halting mechanism is an illustrative example of the switching means and the switching means may take any structure for switching between the all-cylinder operation and the partial-cylinder operation of an engine. One of ordinary skill in the art will also appreciate that throttle valve opening sensor, the intake air temperature sensor, the engine water temperature sensor, the crank angle position sensor, the vehicle speed sensor, and the gear position sensor are illustrative examples of the operating parameter detecting means and the operating parameter detecting means may take any form of sensors that detect operating parameter of a vehicle. Further, the ECU 5 constitutes the instructing means, the diagnosing means, and the permitting means. One of ordinary skill in the art will appreciate that the ECU is an illustrative example for the instructing means, diagnosing means, and permitting means in the preferred embodiment of the present invention, and the instructing means, diagnosing means, and permitting means may be implemented in a distributed fashion, such as by separate control units in other embodiments of the present invention. Specifically, steps S11 to S23, S26 and S27 of FIG. 3 correspond to the instructing means, and steps S24 and 25 of FIG. 3 correspond to the permission means. The process of FIGS. 6 and 7 corresponds to the diagnosis means.

It is to be noted that the present invention described above is not limited to the embodiment described above but various modifications may be made. For example, in the embodiment described above, the failure diagnosis of the O2 sensors 22R and 22L is performed, the present invention can be applied also when performing a failure diagnosis of the LAF sensors 21R and 21L using a method similar to the method shown in FIGS. 6 and 7. In this instance, the partial-cylinder operation is permitted when both of the O2 sensor 22R and the LAF sensor 21R are determined to be normal after the failure diagnosis of them ends.

Furthermore, the present invention can be applied also to a control system for a watercraft propulsion engine such as an outboard engine having a vertically extending crankshaft.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A control system for an internal combustion engine having a plurality of cylinders and switching means for switching between an all-cylinder operation in which all of said cylinders is operated and a partial-cylinder operation in which at least one of said plurality of cylinders is halted, said control system comprising:

operating parameter detecting means for detecting operating parameters of a vehicle driven by said engine, said operating parameters including at least one operating parameter of said engine;

instructing means for instructing said switching means to perform the all-cylinder operation or the partial-cylinder operation according to the operating parameters;

an oxygen concentration sensor provided in an exhaust system corresponding to said at least one cylinder which is halted during the partial-cylinder operation, for detecting an oxygen concentration in exhaust gases;

diagnosing means for diagnosing a failure of said oxygen concentration sensor in a predetermined operating condition including a fuel-cut operation of said engine upon deceleration, in which fuel supply to said engine is stopped; and permitting means for permitting the partial-cylinder operation after completion of the failure diagnosis by said diagnosing means.

2. A control system according to claim 1, wherein said engine has a first bank including a plurality of cylinders and a second bank including a plurality of cylinders, and said plurality of cylinders on the first bank are halted during the partial-cylinder operation.

3. A control system according to claim 2, wherein said engine has a first exhaust pipe connected to said first bank and a second exhaust pipe connected to said second bank, and said oxygen concentration sensor is disposed in said first exhaust pipe.

4. A control system according to claim 1, wherein said diagnosing means determines that said oxygen concentration sensor fails, when an output of said oxygen concentration sensor indicates a rich air-fuel ratio immediately after starting of the fuel-cut operation, and the output of said oxygen concentration sensor still indicates a rich air-fuel ratio after a first predetermined time period has elapsed from the starting of the fuel-cut operation.

5. A control system according to claim 1, wherein said diagnosing means determines that said oxygen concentration sensor is normal, when an output of said oxygen concentration sensor indicates a lean air-fuel ratio immediately after starting of the fuel-cut operation, and the output of said oxygen concentration sensor changes to a value indicative of a rich air-fuel ratio within a second predetermined time period after the fuel cut operation ends.

6. A control method for an internal combustion engine having a plurality of cylinders and switching means for switching between an all-cylinder operation in which all of said cylinders is operated and a partial-cylinder operation in which at least one of said plurality of cylinders is halted, wherein an oxygen concentration sensor is provided in an exhaust system corresponding to said at least one cylinder which is halted during the partial-cylinder operation, for detecting an oxygen concentration in exhaust gases, said control method comprising the steps of:

a) detecting operating parameters of a vehicle driven by said engine, said operating parameters including at least one operating parameter of said engine;

b) instructing said switching means to perform the all-cylinder operation or the partial-cylinder operation according to the operating parameters;

c) diagnosing a failure of said oxygen concentration sensor in a predetermined operating condition including a fuel-cut operation of said engine upon deceleration, in which fuel supply to said engine is stopped; and d) permitting the partial-cylinder operation after completion of the failure diagnosis in said step c).

7. A control method according to claim 6, wherein said engine has a first bank including a plurality of cylinders and a second bank including a plurality of cylinders, and said plurality of cylinders on the first bank are halted during the partial-cylinder operation.

8. A control method according to claim 7, wherein said engine has a first exhaust pipe connected to said first bank and a second exhaust pipe connected to said second bank, and said oxygen concentration sensor is disposed in said first exhaust pipe.

9. A control method according to claim 6, wherein it is determined that said oxygen concentration sensor fails, when an output of said oxygen concentration sensor indicates a rich air-fuel ratio immediately after starting of the fuel-cut operation, and the output of said oxygen concentration sensor still indicates a rich air-fuel ratio after a first predetermined time period has elapsed from the starting of the fuel-cut operation.

10. A control method according to claim 6, wherein it is determined that said oxygen concentration sensor is normal, when an output of said oxygen concentration sensor indicates a lean air-fuel ratio immediately after starting of the fuel-cut operation, and the output of said oxygen concentration sensor changes to a value indicative of a rich air-fuel ratio within a second predetermined time period after the fuel cut operation ends.

11. A computer program embodied on a computer-readable medium for causing a computer to carry out a control method for an internal combustion engine having a plurality of cylinders and switching means for switching between an all-cylinder operation in which all of said cylinders is operated and a partial-cylinder operation in which at least one of said plurality of cylinders is halted, wherein an oxygen concentration sensor is provided in an exhaust system corresponding to said at least one cylinder which is halted during the partial-cylinder operation, for detecting an oxygen concentration in exhaust gases, said control method comprising the steps of:

a) detecting operating parameters of a vehicle driven by said engine, said operating parameters including at least one operating parameter of said engine;

b) instructing said switching means to perform the all-cylinder operation or the partial-cylinder operation according to the operating parameters;

c) diagnosing a failure of said oxygen concentration sensor in a predetermined operating condition including a fuel-cut operation of said engine upon deceleration, in which fuel supply to said engine is stopped; and d) permitting the partial-cylinder operation after completion of the failure diagnosis in said step c).

12. A computer program according to claim 11, wherein said engine has a first bank including a plurality of cylinders and a second bank including a plurality of cylinders, and said plurality of cylinders on the first bank are halted during the partial-cylinder operation.

13. A computer program according to claim 12, wherein said engine has a first exhaust pipe connected to said first bank and a second exhaust pipe connected to said second bank, and said oxygen concentration sensor is disposed in said first exhaust pipe.

14. A computer program according to claim 11, wherein it is determined that said oxygen concentration sensor fails, when an output of said oxygen concentration sensor indicates a rich air-fuel ratio immediately after starting of the fuel-cut operation, and the output of said oxygen concentration sensor still indicates a rich air-fuel ratio after a first predetermined time period has elapsed from the starting of the fuel-cut operation.

15. A computer program according to claim 11, wherein it is determined that said oxygen concentration sensor is normal, when an output of said oxygen concentration sensor indicates a lean air-fuel ratio immediately after starting of the fuel-cut operation, and the output of said oxygen concentration sensor changes to a value indicative of a rich air-fuel ratio within a second predetermined time period after the fuel cut operation ends.

* * * * *